United States Patent [19]

Helwig

[11] 4,069,480

[45] Jan. 17, 1978

[54] BLANKING CIRCUIT FOR ELECTROMAGNETIC DISPLAY

[75] Inventor: Christopher Gordon Helwig, Toronto, Canada

[73] Assignee: Ferranti-Packard Limited, Toronto, Canada

[21] Appl. No.: 756,073

[22] Filed: Jan. 3, 1977

[51] Int. Cl.[2] ..... G08B 5/22

[52] U.S. Cl. ..... 340/373; 340/378 R; 340/166 R

[58] Field of Search ..... 340/373, 378 R, 166 R, 340/336

[56] References Cited

U.S. PATENT DOCUMENTS

| | | | |
|---|---|---|---|
| 3,303,494 | 2/1967 | Taylor | 340/373 |
| 3,469,258 | 9/1969 | Winrow | 340/373 |
| 3,480,959 | 11/1969 | Richmond | 340/166 R |
| 3,680,048 | 7/1972 | Ezaki | 340/166 R |

*Primary Examiner*—Harold I. Pitts

[57] ABSTRACT

Blanking means operable voluntarily or in the event of power failure are provided for an electromagnetically operated display which comprises groups of rotatably mounted elements having opposed faces of contrasting colors, each element carrying a magnet rotatable therewith, the orientation of each element and the choice of contrasting color displayed thereby being determined by the magnetic field formed by an adjacent reversibly permanently magnetizable field forming member. A winding is provided corresponding to each field forming member located so that a pulse through said winding in a predetermined sense will magnetize said field forming member in a corresponding sense. Write circuit means interconnects the windings in such a group and connects them to a power source, the write circuit means being arranged so that the windings of individual elements may be selectively energized to display a desired pattern for said group.

The blanking circuit includes a capacitor and is superimposed upon the write circuit means. The blanking circuit is arranged so that the capacitor may discharge contemporaneously through the windings of the group to produce a predetermined pattern therein and has switching means selectively designed to permit or prevent the discharge and connections allowing the charging of said capacitor.

6 Claims, 4 Drawing Figures

BLANKING CIRCUIT FOR ELECTROMAGNETIC DISPLAY

BACKGROUND OF THE INVENTION

This invention relates to electro-magnetic displays wherein an array of rotatably mounted display elements, each designed to selectively display one of two contrastingly colored faces so that information may be displayed or "written" by the array, by the combined visual effects of the faces displayed by the individual elements.

Such rotatably mounted elements carry magnets and their orientation is controlled by a magnetizable member the sense of whose magnetization is determined by a winding and whose magnetic field controls the orientation of the corresponding element in accord with the sense of magnetization.

Electromagnetic elements of the type referred to are shown in U.S. Pat. Nos. 3,140,553 dated July 14, 1964; 3,283,427 dated Nov. 8, 1966; 3,295,238 dated Jan. 3, 1967; 3,365,824 dated Jan. 30, 1968; and 3,303,494 dated Feb. 7, 1967. Arrays of such elements are shown in U.S. Pat. Nos. 3,303,494; 3,295,238; 283,427; 3,140,553 listed above although the wiring for "writing" such arrays is somewhat different from the wiring described herein.

Such arrays have their windings interconnected by what is known herein as "write" circuitry so that on connection to a power source the individual windings may be individually selectively energized in either sense to produce whatever pattern it is desired to portray in the display. It is usually more convenient to connect said individual windings in groups for such energization. In most applications with which this invention will be used, such groups will correspond to the number of such elements necessary to form a letter or number and such group is customarily a rectangular array of 35 of said elements in 7 rows and 5 columns. It will be noted that such write circuitry will have the capacity, in addition to the other permutations of elements, to energize the windings so as to cause all the display elements in a group (hence by multiplicity of group controls all the elements in a display) to display the same color so that no information is displayed or, as frequently described herein, the display is 'blanked'. However it will be noted that the blanking effect cannot be achieved in the event of power failure or malfunction of the write logic.

Such displays must from time to time be 'blanked', that is, energized so that all elements show the same color either: because of power failure (most importantly); because no information is being displayed or; because information has been incorrectly written or because information which was correct when written is no longer correct. Since the information displayed on such signs is often of vital importance, giving the time of an airline departure or the location of an accident or obstruction on a freeway, it is important that it be possible to quickly and certainly "blank" a sign that is not or is no longer correct.

SUMMARY OF INVENTION

It is principal object of the invention to provide a blanking circuit for producing in the elements of a display a uniform or neutral pattern which does not require an operating power supply or operation of the write logic. The blanking circuit includes a capacitor and is superimposed upon the write circuitry, the blanking circuit being arranged so that said capacitor may discharge contemporaneously through all the windings of the elements in a group to produce a predetermined or blanking pattern. Thus a capacitor and blanking circuit will blank a group of elements in an array and as many such blanking circuits may be provided as there are groups. Means are provided for charging the capacitor during periods when the power is on so that the capacitor may be used, if necessary when the power fails. Switching means can be provided, operable on power failure, to discharge the capacitor or operable on voluntary control to discharge the capacitor. The blanking circuit, connected to simultaneously energize all windings in a group will provide collateral connections between windings which, without preventative measures would interfere with the collective operation of the write circuit. Rectifiers are inserted in the blanking circuit, where required, poled to prevent the presence of the blanking circuit from interfering with the operation of the write circuit. Such rectifiers are, of course, also poled to conduct the discharge current from the capacitor to the windings.

Usually the connections of the blanking circuit will be arranged to energize all windings in a group, (and by multiplexing in an array), to display a uniform color therein. It is important to note, however, that the blanking pattern need not produce a uniform color but may produce any selected pattern. However since the blanking circuit is superimposed upon an existing write circuit, many patterns for the blanking circuit will be found economically impractical.

It is an object of the invention to provide that a capacitor is available for connection to a group of the array elements, connectable to discharge through and thereby to energize the corresponding windings corresponding to the group to cause their corresponding elements to display whichever of the contrasting colors has been selected to be displayed in the "blanked" appearance. As many of such capacitors are normally provided, each connected to blank a group of display elements as are necessary to blank the entire array. The elements of an array are customarily arranged to be energized by groups (usually) corresponding to characters in the array and a capacitor, in such an arrangement, is provided to blank a corresponding group. The capacitors are connected to be charged between blanking operations and connectable to discharge through the display elements independent of the "write" or information display energization so that the display may be blanked by the capacitors whether or not there is failure or partial failure of the write circuit or of the power supply.

The inventive circuit has particular advantage where the elements are arranged in a rectangular array, energized by row and column selection and where the coils are connected in such a way for energization by the blanking circuit that coils may be connected in series across the capacitor. This allows the most efficient use of the capacitor in 'blanking' the elements.

BRIEF DESCRIPTION OF THE DRAWINGS

In drawings which illustrate a preferred embodiment of the invention.

SPECIFIC EMBODIMENT

Figure 1:
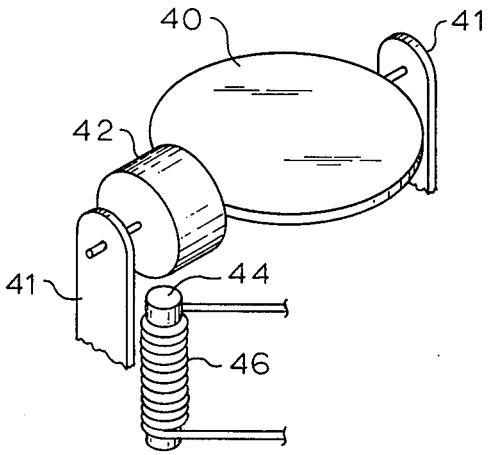
FIG. 1 shows a display element of the type with which the invention may be used.

FIG. 1 shows one of a number of electromagnetically operated rotatably mounted elements which may be used. In all such elements a generally flat rotatable element, such as disc 40 has a magnet 42 rotatable therewith. Although the magnet is physically circular in the drawing it is constructed of a material defining a magnetic axis perpendicular to the axis of rotation and here perpendicular to the plane of disc 40. The disc 40 is, as shown, rotatably mounted on brackets 41. The disc 40 is provided with contrastingly on colored faces on opposite sides so that a group of such disc selectively displaying their contrasting faces collectively provide a part of information as demonstrated by FIG. 2, and a number of such groups in an array provides the complete information. A magnetizable member, here polepiece 44 is mounted exterior to the disc 40 but located so that the magnetic field of pole piece 44 will affect magnet 42 throughout the locus of movement of the latter. The polepiece 44 may be of any desired material which under selectively reversible magnetizations will (in the absence of an applied field) produce sufficient remanence flux, and will have sufficient coercivity to retain the element in its desired orientation on return it thereto if displaced. By the term "reversibly permanently magnetizable" herein in relation to the pole piece 44 or other equivalent member is meant a pole piece being reversible in magnetization but capable of having sufficient remanence flux and having sufficient coercivity to retain the orientation of the element with no sustaining current in the polepiece winding. A winding 46 about pole piece 44 is energized by electric current pulses to magnetize the pole piece in the sense desired. The magnetization of the pole piece 44 determines which contrasting face of the disc 40 is displayed and the magnetized pole piece 44 will hold the element in the selected position until the winding 46 is pulsed in a direction to alter the magnetization. It will be obvious that so far as this invention is concerned the pole piece may be replaced by a U-shaped arrangement with uprights of the U forming a pair of pole pieces both located near the magnet locus and with the winding 46 about the crossbar of the U. (such as that shown in U.S. Pat. No. 3,518,664 issued June 30, 1970, or U.S. Pat. No. 3,295,238 issued June 3, 1967). Instead of placing the magnet 42 at the end of the rotatable element as shown it may be located in or on the disc itself as, for example, is shown in U.S. Pat. No. 3,295,238.

In this application a winding is said to be "energized" to "magnetize" the magnetizable member to display a particular color, (say black). Since the operation of the elements involves the energization of a winding to display one color even though it is already that color, the terms "energization" and "magnetization" include the situation where the magnetization was previously in the desired sense.

Figure 2:
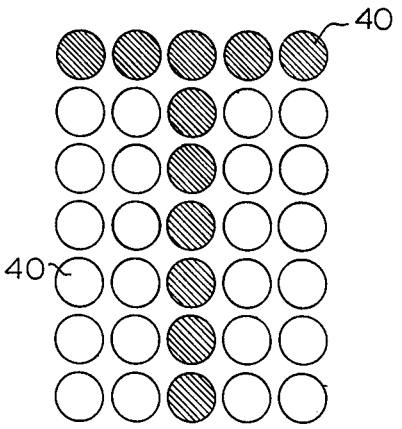
FIG. 2 shows the arrangement of a group of 35 of the display elements in FIG. 1 in 7 rows and 5 columns energized to write the letter "T" as part of an array.

FIG. 2 shows the arrangement of a group of 35 of the elements of FIG. 1 in 7 rows and 5 columns in the customary arrangement for forming letters and numbers, the elements are shown forming a "T". In the preferred form of display, such a group of 7 × 5 units form part of a larger array. The ends of winding 46 are arranged in sub-groups with the first sub groups corresponding to one end of each winding differing from the second sub groups corresponding to the other end of each winding and arranged so that the combination of a first and a second sub group is unique for each winding. Thus one end of all the windings in a first sub-group may be energized simultaneously along with selected second sub groups energize selected windings. On the preferred embodiment, the first sub groups are windings in the same row of the rectangular array and the second sub groups are windings in the same column of the array. In the group, as in the remainder of the array, an element (here disc 40) is "operated" or switched to a desired state of displaying the selected one of the light or dark sides by energizing a lead characteristic of the row of the element and a lead characteristic of its column. The number of rows and columns in the array as a whole or the number of rows and columns in a group (such as the 7 × 5 arrangement) is not essential to the invention. The invention is, however, principally concerned with displays where the elements are arranged in rows and columns and energized in accord with a row and a column selection.

Figure 3:
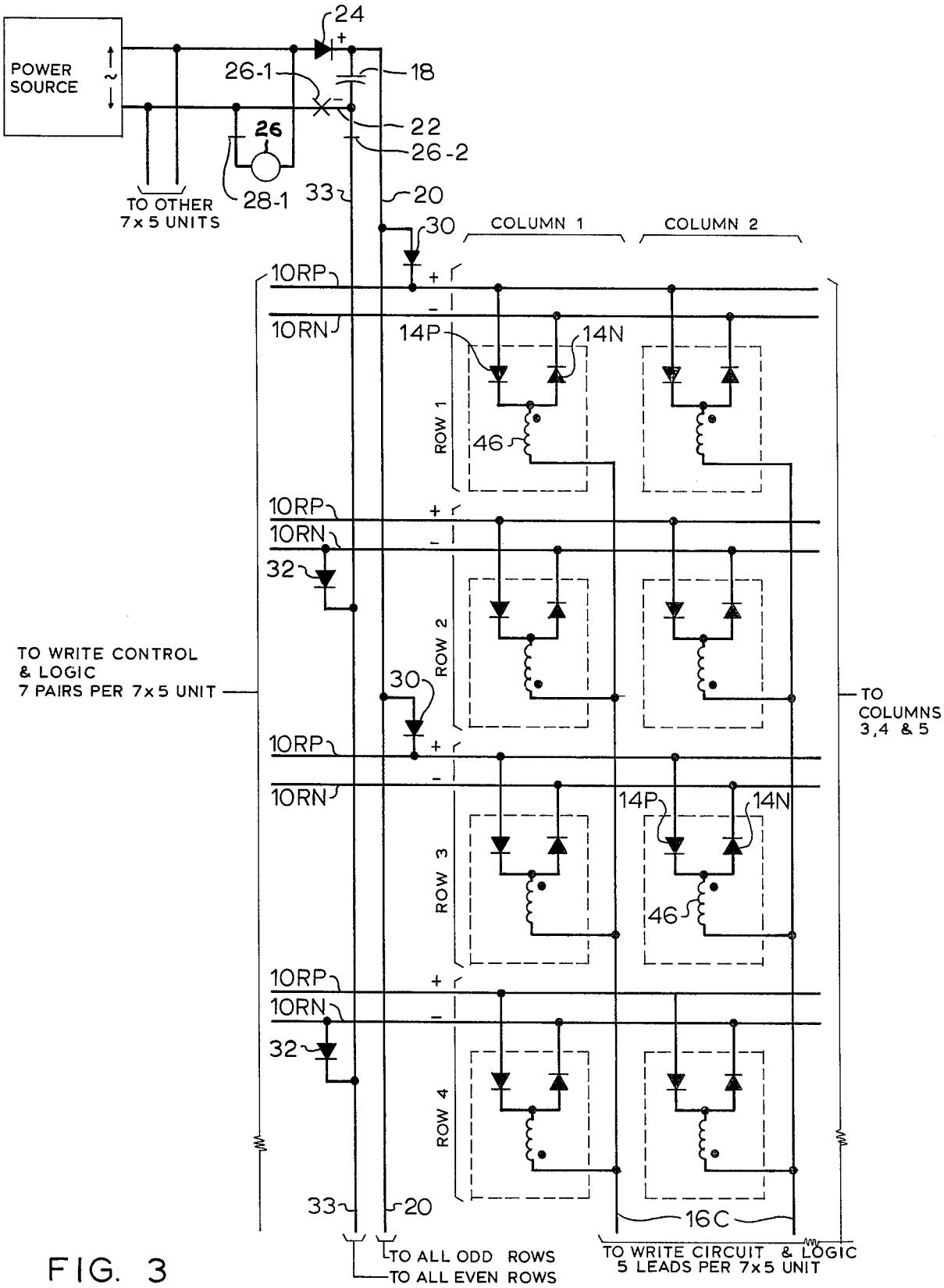
FIG. 3 shows a portion of the wiring diagram for the elements of FIG. 2 including the blanking circuit for the group.

In FIG. 3 is shown the preferred wiring for a group in an array, in accord with the invention applied to a 7 row and 5 column group. (only part of 4 rows and 2 columns are shown). In the normal wiring each row has positive and negative "write" row leads 10RP and 10RN, respectively, to the same end of the winding 46 of each element corresponding to the row. The positive and negative row leads are connected to the end of winding 46 through rectifiers 14P and 14N poled to conduct, respectively, from the lead 10RP to the winding end and from the winding end to the lead RN.

The end of each element winding 46 remote from the row connected to the row leads 10RP and 10RN is connected to a lead 16C common to the elements in a column of the 7 × 5 set.

The display of a selected one of the contrasting colors by an element is achieved by selecting the one of the row leads 10RP or 10RN corresponding to the row of the element and to the color to be displayed and the column lead corresponding to the element and applying a pulse in the correct sense over the selected row and column leads. The pulse will be of sufficient power to reverse the magnetism in the polepiece 44 of the selected winding, if necessary, it being noted that any given element may be already in its desired orientation, and its pole piece correctly magnetized. It will also be noted that, with the wiring shown, all the elements in a column may be "written" simultaneously, since the selected column leads 16C and a lead 10RP or 10RN for each of the rows involved may be simultaneously pulsed. In the embodiment shown in the 7 by 5 group the wiring is the same for all 7 rows and 5 columns and this arrangement is repeated for each 7 × 5 group in the array.

The circuitry, as above described, represents the preferred arrangement for "writing" or displaying information on a rectangular array independently of the number of rows and columns, and independently of the number of groups into which the display is divided.

It will be appreciated that the terms 'row' and 'column' are completely interchangeable so that the "row" lead may correspond to the end of the winding having a single connection and there may be two "column" leads.

However using the terms "row" and "column" as used in connection with FIG. 3, it will be noted from the black dots at ends of windings 46 that when used in accord with the invention it is preferred to arrange the sense of the windings oppositely in alternative rows. The effect is that in the first third, fifth and seventh row, energization of leads 10RP with a column lead 16C produces one color then the same color is produced in the second fourth and sixth row by energization of a column 16C and leads 10RN for those rows.

It will be appreciated that the reversal of the sense of the windings of alternate rows alters the logic of the 'write' circuits to a minor extent but does not impair their ability to write the characters or other visual arrangement on the display.

To the circuit as designed above there is added the 'blanking' circuit to be described.

The 'blanking' circuit comprises a capacitor 18 connected across a pair of lines 20 and 22 from a power source. An A.C or D.C source may be used but if, as shown, an A.C source is used then a rectifier 24 is placed in one of the lines (here 20) to determine the polarity of the charge on the Capacitor 18. Normally open relay contacts 26-1 are located in one of the lines (here 22) to connect and disconnect the capacitor from the power sources. A circuit is provided to be operable to close the contacts 26-1 when the power is on and to open these contacts when the power is off. This circuit may take any form within the scope of the invention but is here shown schematically as a relay 26 connected across lines 20 and 22 so that contacts 26 - 1 are closed whenever there is power across lines 20 and 22. Normally closed contacts 28-1 are provided for operation by a control not shown to schematically represent the control to de-energize relay 26 (and hence to release its contacts when the power is on. The positive side of capacitor 18 is connected to each of the leads 10RP of alternate rows here the odd numbered ones through a rectifier 30 poled to conduct from the capacitor 18 toward the odd numbered row leads 10RP, and the negative side of condenser 30 is connected to the other alternate leads 10RN (here leads 10RN of the even numbered rows) through a rectifier 32 poled to conduct from the even leads 10RN to the capacitor 18. In one of the connections from the capacitor 18 to the leads (here the connection to leads 10RN), are the normally closed contacts 26-2 of relay 26. It will be noted that during the ordinary operation of the display, with information being written, relay 26 is energized, contacts 26-2 are open, and hence the circuit including odd row leads 10RP, even row leads 10RN and the capacitor is open.

In normal operation of the display, with the contacts 28-1 closed, and power on relay 26, contacts 26-1 are closed and capacitor 18 is charged positively through the power source as rectified by rectifier 24. The charged capacitor 18 does not affect the operation of the display through the write circuit logic since contacts 26-2 are open.

The display (using the displayed portion thereof as an example) may be "blanked" or converted to display a uniform pattern when out of service.

a. automatically, in the event of power failure
b. as required under control in the event of an error by the write circuit, or for other reason.

a. In the event of power failure, relay 26 is deenergized, contacts 26-1 open, disconnecting the condenser from the power source, and contacts 26-2 close. The closure of contacts 26-2 completes a circuit for the discharge of the capacitor 18 from the positive side thereof over rectifier 30 to the 10P leads of the 1st, 3rd, 5th and 7th rows, over rectifiers 14P and to the windings of the odd rows through the winding 46 of the corresponding rows to the column leads 16C through the windings 46 of the even numbered rows, over their diodes 14N and contacts 26-2 to the negative side of the capacitor 18. The capacitor 18 thus discharges through the windings of the 7 × 5 group and the condenser charge is selected as sufficient to magnetize any of such windings oppositely set so that the result is that all windings 46 and the corresponding elements are set to the blanking position.

The elements hold their blanking position due to the remanence and coercivity of the pole pieces until power is restored. When power is restored the relay 26 is reenergized, contacts 26-2 are open to disconnect the capacitor 18 from the windings 46 and contacts 26-1 are reclosed to again charge the condenser.

b. The operation for controlled blanking of the display is similar to the automatic blanking except that, instead of power failure, the contacts 28-1 would be opened by means not shown to de-energize relay 26 causing the blanking to take place. When contacts 28-1 are again reclosed, the capacitor is disconnected from the circuit at 26-2 and commences to recharge over 26-1.

Similar blanking circuitry, as described, is provided for each 7 × 5 (or other dimensioned) group in the array and thus the entire display may be blanked in a similar manner to that described. Although contacts 26-1, 26-2 and 28-1 are shown as relay contacts and although this is a practical mode of operation the currents involved will tend to wear out the relay contacts with undue rapidity.

Accordingly it is preferred that what are shown as contacts 26-1, 26-2 and 28-1 will be embodied by silicon controlled rectifiers (SCR's) with the relay 26 being embodied by the gate control for the 26-1 and 26-2 SCR's and there being a similar control for the 28-1 SCR.

Where the coils in adjacent rows are oppositely wound or connected as shown, the charge on the capacitor 18 is more efficiently used since there is a series connection of windings across the capacitor 18. (The windings in all alternate rows are in parallel with each other but in series with the windings in the other alternate rows), allows more efficient use of the capacitor. Thus with this arrangement a smaller capacitor may be used then if all coils in the 7 × 5 group were simply in parallel with one another as would be the case if all windings were wound in the same sense.

In spite of the increased efficiency of the above described arrangement it is desired to describe the alternative where all coils are wound in the same sense.

Figure 4:
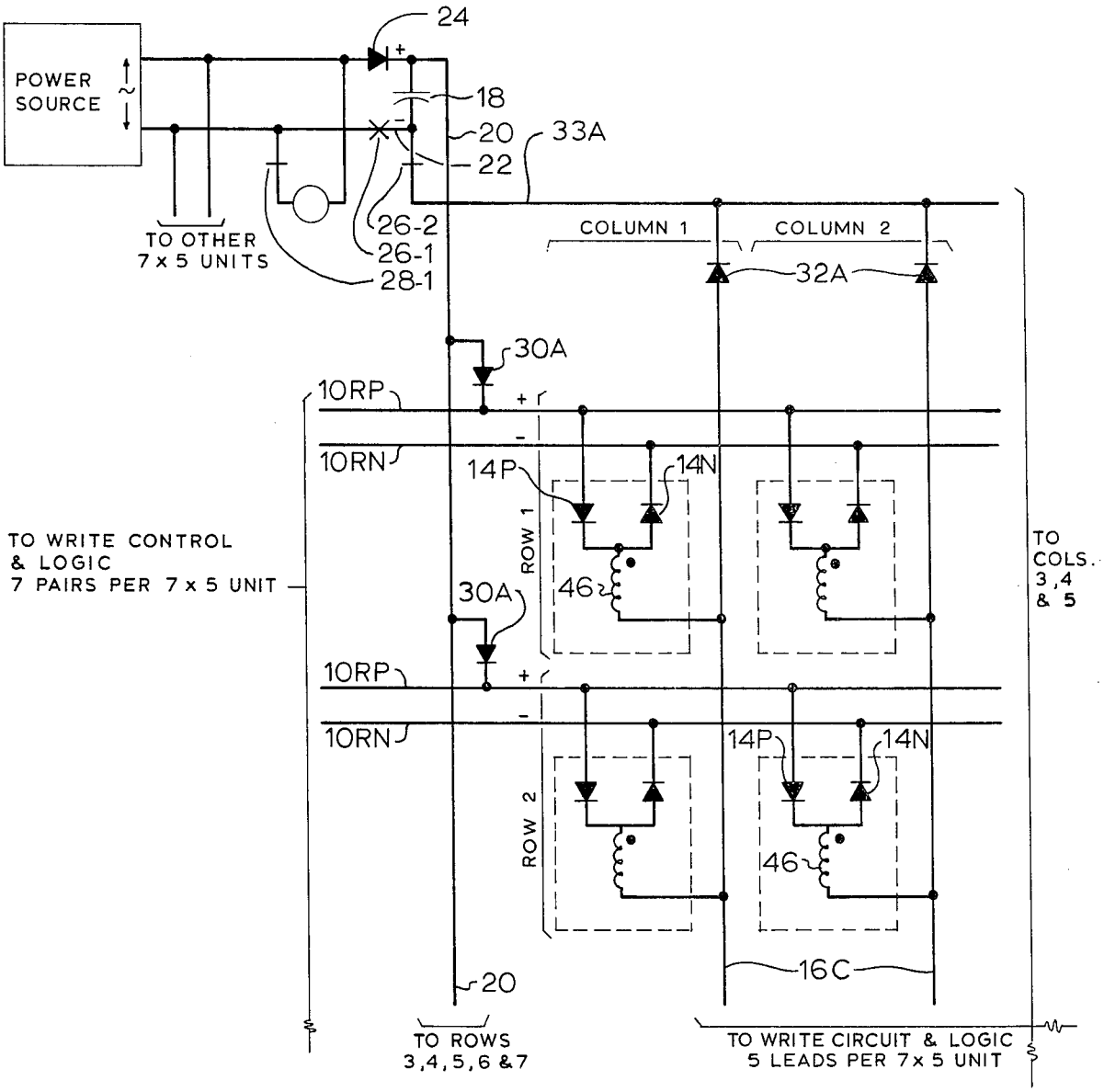
FIG. 4 shows an alternative arrangement for wiring the elements of FIG. 2 including the blanking circuit for the group.

FIG. 4 the left two columns of the upper two rows of a 7 × 5 group are shown where connections of the write circuit are the same as those of FIG. 3 except that all windings 46 are wound or connected in the same sense.

The input side of the capacitor 18 including the power source, relay 26, contacts 26-1, 28-1 is the same as FIG. 3. As previously noted, by implication, the capacitor 18 will have to be larger than the similar capacitor 18 in FIG. 3 since the coils will all be in parallel with each other, i.e. there will not be a series arrangement.

The output side of the capacitor 18, in FIG. 4, is connected somewhat differently from FIG. 3. Since all windings 46 are wound (or connected) in the same sense, the positive side of the capacitor is connected to each of the row lines (here 10RP) for the 7 × 5 unit through rectifiers 30A poled to conduct in the same direction as the rectifier 14P from the respective row lead to the winding 46. Each of the column lines 16C is connected through a rectifier 32A to a line 33A contacts 26-2 the rectifiers 32A being poled to conduct in the direction from the column line 16C to line 33A. (It will be noted that if it is desired to "blank" the display in the opposite color then the negative side of capacitor 18 would be connected to lines 10RN instead of 10RP through a rectifier oppositely poled to rectifier 30A while each column line is connected to line 33A through a rectifier oppositely poled to rectifier 32A and contacts 26-2 are connected to the positive side of capacitor 18).

The operation of the circuit as shown in FIG. 4 is similar to that of FIG. 3. In the normal operation of the display under control of the "write" logic and control, contacts 26-1 are closed (relay 26 is energized) and capacitor 18 is being charged. In the event of involuntary power failure or voluntary opening of contacts 28-1 relay 26 is deenergized, contacts 26-1 open and contacts 26-2 close. The condenser discharges over rectifiers 30A, over all the windings in parallel, and over rectifiers 14P blanking the 7 × 5 group. A blanking circuit including a capacitor 18 for each group in the array will effect the same result, effectively blanking the display. When it is desired to again charge the capacitor 18, the power is applied to relay 26 or the contacts 28-1 are again closed (whatever is the reversal of the discharging operation). Relay 26 operates to open the discharge circuit for the capacitor 18 and to close the charging circuit.

It will be seen that, in general, the blanking circuit for a display provides a circuit which allows charging of a capacitor when power is available, the capacity and characteristics of the condenser corresponding to a group of elements of a display. On power failure or voluntarily (these need not be both present) the capacitor is disconnected from its charging circuit and connected to the element windings in a sense to magnetize the corresponding magnetizable elements in a sense to cause the discs to display a predetermined blanking pattern. Rectifiers as required between each side of the capacitor and the normal circuitry of the group allow discharge current flow from the capacitor but prevent current flow between rows or between columns not normally connected for the "write" operation.

The blanking circuit allows the connection of some windings in series where the pre existing circuit arrangement makes this feasible with the consequent increase in voltage and decrease in current contributing to the efficiency of the capacitor.

The designations "row" and "columns" are interchangeable in the claims and are used singly therein for brevity. Thus where a claim states certain characteristics of a column and others of a row it will be realized that the claim covers the construction where the characteristics are interchanged or covers the construction where the names "row" and "column" in the claims are interchanged.

I claim:

1. In an electromagnetically operated display comprising groups of rotatably mounted elements having opposed faces of contrasting colors and each carrying a magnet rotatable therewith; the operation of each said element and the choice of contrasting color displayed thereby, being determined by the magnetic field formed by an adjacent reversibly permanently magnetizable field forming member, a winding corresponding to each field forming member located so that a pulse through said winding in a predetermined sense will magnetize said field forming member in a corresponding sense, wherein groups of said elements are arranged in rows and columns, one end of each winding corresponding to elements in the same column in such group being connected to a column lead, the other end of each winding corresponding to elements in the same row in such group being connected both to a positive row lead by a rectifying means poled to conduct from said positive lead toward said winding and to a negative row lead by a rectifying means poled to conduct from said winding toward said negative lead, whereby an element may be caused to display a selected one of its contrasting faces by application of a pulse in the proper sense across one of the row leads corresponding to the element and the column lead corresponding to the element, the windings of elements connected to the same row leads being wound in one sense, the windings of elements connected to some pairs of row leads being wound in the opposite sense to windings connected to other pairs of row leads, a capacitor, a connection to one side of said capacitor connected to each of the positive row leads of the group corresponding to elements with windings in one sense, through a rectifier poled to conduct in the direction from the condenser toward the respective row lead, a connection to the other side of said capacitor connected to each of the negative row leads with windings in the other sense, through a rectifier poled to conduct in the direction from the respective negative row lead toward the condenser, means for selectively connecting and disconnecting one of said connections to said capacitor, means for charging said capacitor.

2. In an electromagnetically operated display comprising groups of rotatably mounted elements having opposed faces of contrasting colors and each carrying a magnet rotatable therewith, the orientation of each said element and the choice of contrasting color displayed thereby, being determined by the magnetic field formed by an adjacent reversibly permanently magnetizable field forming member, a winding corresponding to each field forming member located so that a pulse through said winding in a predetermined sense will magnetize said field forming member in a corresponding sense, circuitry for connecting said windings to allow selective energization thereof to produce a pattern of contrasting surfaces in said group, means for energizing the elements in said group collectively, comprising a capacitor, means for charging said capacitor, circuitry providing a discharge path for said capacitor through the windings of the elements in said group in a sense to cause such elements to display a blanking pattern, means for selectively connecting and disconnecting said discharge path circuitry, and rectifier means in said discharge circuitry designed to allow the discharge of said condenser through said windings but preventing the interference of said circuit with normal write operations.

3. In an electromagnetically operated display as claimed in claim 2, wherein said circuitry to allow selective energization is arranged so that one end of windings of first sub-groups of elements in such group is connected to a first common lead and the other end of windings of each of second sub groupings of elements in said group is connected to a second common lead, said first and second sub-groupings being arranged so that only one element is common to a particular first and second sub grouping, wherein said circuitry for providing a discharge path for said capacitor is connected to allow said capacitor discharge through the windings in a sense to cause said elements to display a blanking pattern, rectifying means in said discharge path circuitry for preventing said discharge path from providing collateral paths which would inhibit said selective energization.

4. In an array comprising groups of electromagnetically actuable, rotatably mounted display elements, each designed to selectively display one or the other of two contrasting colors, in two opposing orientations of the display element, each element having a reversibly permanently magnetizable field forming member, designed to control the orientation of the element's rotatable member in accord with the sense of magnetization of said member, at least one winding corresponding to each magnetizable member designed to produce the magnetization thereof in a sense to cause the corresponding rotatable element to display one of said colors, each said winding in a group being connectable by first connections to means for energization thereof for producing said magnetization in said at least one sense, a capacitor, corresponding to each such group, means for charging said capacitor, connections allowing simultaneous discharge of said condenser through the windings corresponding to said group, means for completing said condenser connections through said condenser to achieve such simultaneous discharge and disconnecting said condenser at other times, rectifying means for preventing undesired currents between windings along said condenser connections during energization of windings by said first connections.

5. In an electromagnetically operated display comprising groups of rotatably mounted elements having opposed faces of contrasting colors and each carrying a magnet rotatable therewith, the orientation of each said element and the choice of contrasting color displayed thereby, being determined by the magnetic field formed by an adjacent reversibly permanently magnetizable field forming member, a winding corresponding to each field forming member located so that a pulse through said winding in a predetermined sense will magnetize said field forming member in a corresponding sense, write circuit means for interconnecting the elements in said group and for connecting said elements to a power source, said write circuit means being arranged so that the windings of individual elements may be selectively energized to display a desired pattern for said group, blanking circuit means including a capacitor superimposed upon said write circuit means, the blanking circuit being arranged so that said capacitor may discharge contemporaneously through the windings of said group to produce a predetermined pattern therein, switching means selectively designed to permit or prevent said discharge, and connections allowing the charging of said capacitor.

6. In a display as claimed in claim 5 including rectifier means in said blanking circuitry poled to allow such discharge and poled and located to prevent the presence of said blanking circuit from providing collateral paths for said write circuit.

* * * * *